US006385861B1

(12) United States Patent
Blackwell et al.

(10) Patent No.: US 6,385,861 B1
(45) Date of Patent: May 14, 2002

(54) RAIL ALIGNMENT TOOL

(75) Inventors: Charles V. Blackwell, Cuba; Terry E. Turner, Rolla; Bobby L. Smith, Cuba, all of MO (US)

(73) Assignee: The Burlington Northern and Santa Fe Railway Company, Fort Worth, TX (US)

( * ) Notice: Subject to any disclaimer, the term of this patent is extended or adjusted under 35 U.S.C. 154(b) by 0 days.

(21) Appl. No.: 09/634,899

(22) Filed: Aug. 9, 2000

Related U.S. Application Data

(60) Provisional application No. 60/147,963, filed on Aug. 9, 1999.

(51) Int. Cl.[7] ..... E01B 29/04; E01B 33/00; B25B 27/14; B25B 1/20

(52) U.S. Cl. ..... 33/651.1; 269/43; 104/7.2; 104/2; 29/271

(58) Field of Search ..... 33/613, 645, 521, 33/523, 523.1, 651.1, 651, 1 Q, 287, 338, 533; 269/43; 29/271, 272; 228/49.3, 49.4; 104/2, 7.2

(56) References Cited

U.S. PATENT DOCUMENTS

| | | | | | |
|---|---|---|---|---|---|
| 700,994 | A | | 5/1902 | Torre et al. | 219/53 |
| 3,711,920 | A | * | 1/1973 | Simmons, Jr. | 269/43 |
| 3,888,477 | A | * | 6/1975 | Tate | 269/43 |
| 4,195,828 | A | * | 4/1980 | Peterson | 269/43 |
| 4,270,036 | A | | 5/1981 | Zollinger | 219/53 |
| 4,320,708 | A | | 3/1982 | Bommart | 104/112 |
| 4,413,415 | A | * | 11/1983 | Stovall | 269/43 |
| 4,641,818 | A | | 2/1987 | Bommart | 269/43 |
| 4,674,730 | A | | 6/1987 | Roberts | 269/43 |
| 4,750,662 | A | * | 6/1988 | Kagimoto | 269/83 |
| 4,800,817 | A | | 1/1989 | Carstensen et al. | 104/2 |
| 4,960,137 | A | * | 10/1990 | Pott et al. | 269/43 |
| 5,094,004 | A | * | 3/1992 | Wooten | 33/338 |
| 5,297,482 | A | * | 3/1994 | Cleveland | 104/7.2 |
| 5,575,416 | A | | 11/1996 | Oellerer et al. | 228/49.1 |
| 6,220,169 | B1 | * | 4/2001 | Rosenquist et al. | 104/2 |

FOREIGN PATENT DOCUMENTS

| | | | | |
|---|---|---|---|---|
| DE | 32-09-984 A1 | * | 10/1981 | 269/43 |

* cited by examiner

*Primary Examiner*—Randy W. Gibson
(74) *Attorney, Agent, or Firm*—Melvin A. Hunn; James E. Walton; Hill & Hunn, LLP

(57) ABSTRACT

A rail alignment system for locating a first end piece and a second end piece of a first rail section and a second rail section. The rail alignment system comprises (a) a first rail alignment tool for engaging and applying force to said first rail section; and (b) a second rail alignment tool for engaging and applying force to said second rail section. The first rail alignment tool includes: (1) a planar plate for extending transversely beneath said first rail section; (2) a pair of block members, each secured to said planar plate and each defining a threaded cavity which is substantially orthogonal to said first rail section and which are aligned with one another; (3) a pair of externally threaded bolts, each adapted for engaging one of said threaded cavities of said pair of block members; and (4) a pair of contoured rail engagement end pieces, each secured to an inner terminating portion of said pair of externally threaded bolts for engaging said first rail section. The second rail alignment tool includes: (1) a planar plate for extending transversely beneath said second rail section; (2) a pair of block members, each secured to said planar plate and each defining a threaded cavity which is substantially orthogonal to said second rail section and which are aligned with one another; (3) a pair of externally threaded bolts, each adapted for engaging one of said cavities of said pair of block members; and (4) a pair of contoured rail engagement end pieces, each secured to an inner terminating portion of said pair of externally threaded bolts for engaging said second rail section. Said first end piece of said first rail section and said second rail section may be aligned by selectively applying torque to said two pair of externally threaded bolts.

6 Claims, 4 Drawing Sheets

SIDE VIEW

BACK VIEW (PARTIAL)
R.S. VIEW
FRONT VIEW

RAIL ALIGNMENT TOOL

This application claims the benefit of U.S. Provisional Application No. 60/147,963, filed Aug. 9, 1999.

BACKGROUND OF THE INVENTION

1. Field of the Invention

The present invention relates in general to tools which are utilized to align railroad rails, and in particular to tools which are utilized to align abutting rails in order to allow weldment of the rails together.

2. Description of the Prior Art

All railroads have a considerable investment in their infrastructure. However, the infrastructure requires continuous attention and repair. For example, as rail becomes worn or damaged, it must be replaced. Currently, rail is in relatively long continuous sections; however, these sections must be butt welded together in order to allow for safe and efficient locomotion over the rail. In order to get a good weldment between the end pieces of rail sections, in the prior art, work crews have utilized manual equipment, such as mauls, hammers, and wedges to align the ends of the rails prior to weldment. Having railroad crews operate this heavy equipment inherently carries a risk of injury to the employee. For example, if the rail is very old or brittle, metal chips may fly off during the hammering and wedging operations. Additionally, using the heavy equipment is also inherently risky. Any new rail equipment which can reduce the risk of injury to rail crews is typically quickly and readily adopted by the industry.

SUMMARY OF THE INVENTION

It is one objective of the present invention to provide a rail alignment tool which replaces the utilization of mauls, hammers, and wedges in order to align end pieces of rail section prior to weldment.

It is another objective of the present invention to provide an improved rail alignment tool which allows rail pieces to be aligned, but which only requires the work crew to apply torque to a plurality of threaded bolt members, which is far safer than utilizing mauls, hammers, and wedges.

It is yet another objective of the present invention to provide an improved rail alignment tool which is durable, lightweight, and which requires little or no maintenance, but which is safe to operate and which provides for good alignment of rail sections to allow for good welds to be made between adjoining rail sections.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of the preferred embodiment when read in conjunction with the accompanying drawings, wherein:

DETAILED DESCRIPTION OF THE INVENTION

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended clams will cover any such modifications or embodiments that fall within the scope of the invention.

Figure 1:
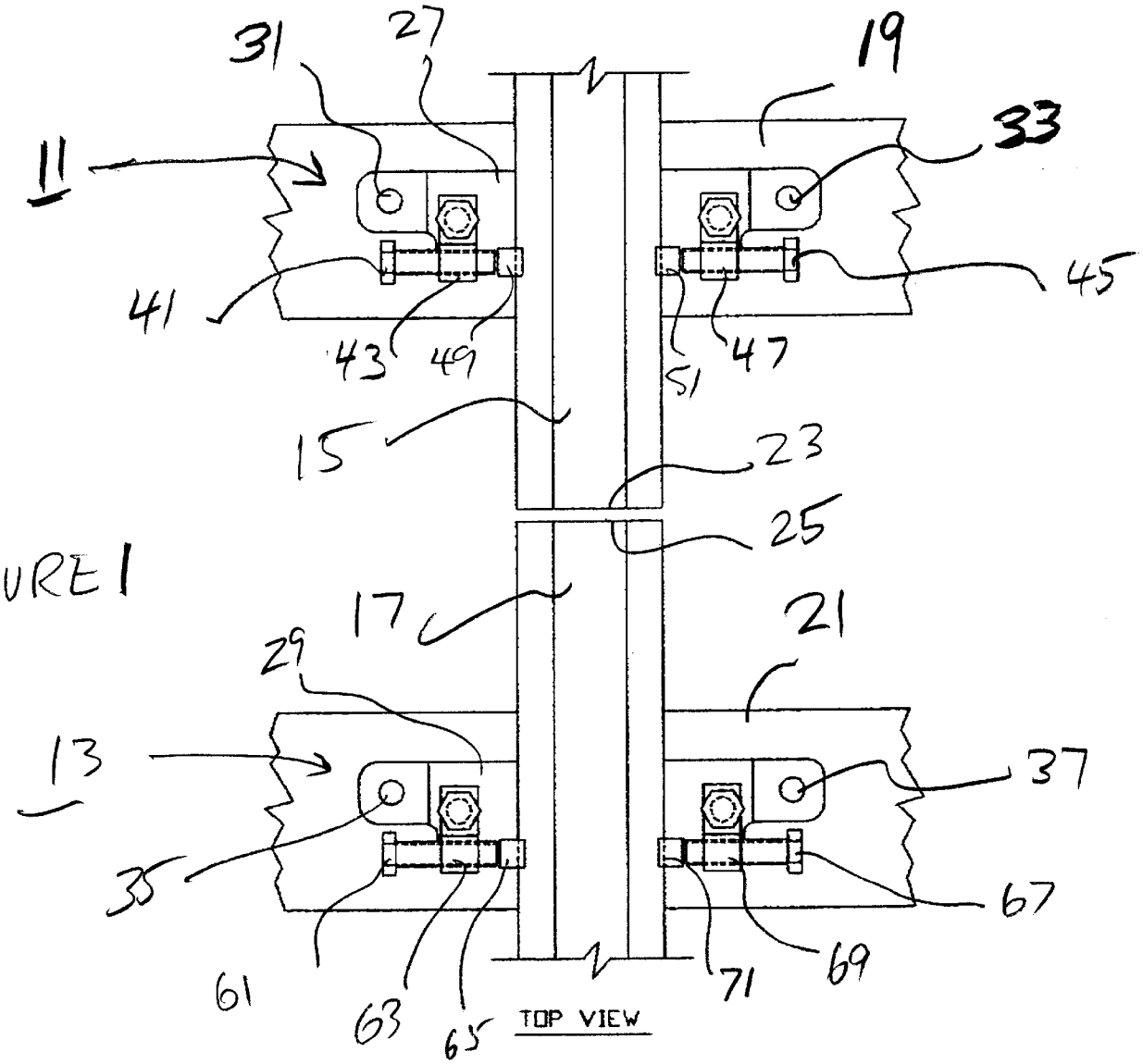
FIG. 1 is a top view of the rail alignment tool of the preferred embodiment of the present invention in use to align two sections of rail prior to weldment.

FIG. 1 is a top view of rail alignment tools 11, 13 being utilized to align rail segments 15, 17 in abutting relationship prior to weldment, and in order to obtain good alignment between rails 15, 17. Rail alignment tool 11 is utilized to determine the location of end 23 of rail 15, while rail alignment tool 13 is utilized to determine the location of end 23 of rail 17. Rail alignment tools 11, 13 may be adjusted incrementally in order to provide for good alignment between rails 15, 17. Once the rails 15, 17 are aligned, a welding crew may make a butt weld between rails 15, 17 in order to provide for one continuous rail. In other words, the gap between ends 23, 25 (which is exaggerated in the view of FIG. 1) is the location of the weld.

Rail alignment tool 11 includes a metal plate 27 which slides between rail 15 and tie 19. In the embodiment depicted in this patent application wooden ties are contemplated; however, the invention may be utilized with concrete or other ties. Plate 27 includes spike ports 31, 33 which are utilized to secure plate 27 in a fixed position relative to tie 19. Other types of clamping or securing means may be utilized, especially when the tie is a concrete type tie, as opposed to a wooden tie. Rail alignment tool 11 includes torque-adjustable bolts 41, 45 which are utilized to apply force to rail 15 to adjust the position of its ends 23. Bolt 41 is adapted to pass through a bolt receptacle in block 43, while bolt 45 is adapted to pass through a bolt receptacle in block 47. Rail engagement end pieces 49, 51 are secured to the outer end of bolts 41, 45 respectively, in order to engage rail 15 and allow for efficient transfer of force from bolts 41, 45 to rail 15. Preferably, end pieces 49, 51 are profiled or contoured in a manner which provide for good mating contact with a portion of rail 15.

In accordance with the present invention, bolts 41, 45 may be torqued in a manner which collectively fixes the location of end piece 23 of rail 15. At the same time, rail alignment tool 13 is similarly attached to abutting rail 17 in order to determine the location of end piece 25. As is shown, rail alignment tool 13 includes plate 29 which is located between wooden tie 21 and rail 17. Spike holes 35, 37 are provided within plate 29 in order to allow railroad spikes to secure and fix in position plate 29. Torque may be applied to bolts 61, 67 in order to move the bolt inward or outward relative to mating pieces 63, 69. End pieces 65, 71 are secured to the innermost ends of bolts 61, 63 and are contoured in order to engage rail 17 and determine the location of end piece 25 of rail 17.

Collectively, as torque is applied to bolts 41, 45, 61, 67, the bolts are moved inward and outward relative to plates 27, 29 in order to determine the location of end pieces 23, 25 of rails 15, 17 in order to place them in proper alignment for weldment.

Figure 2:
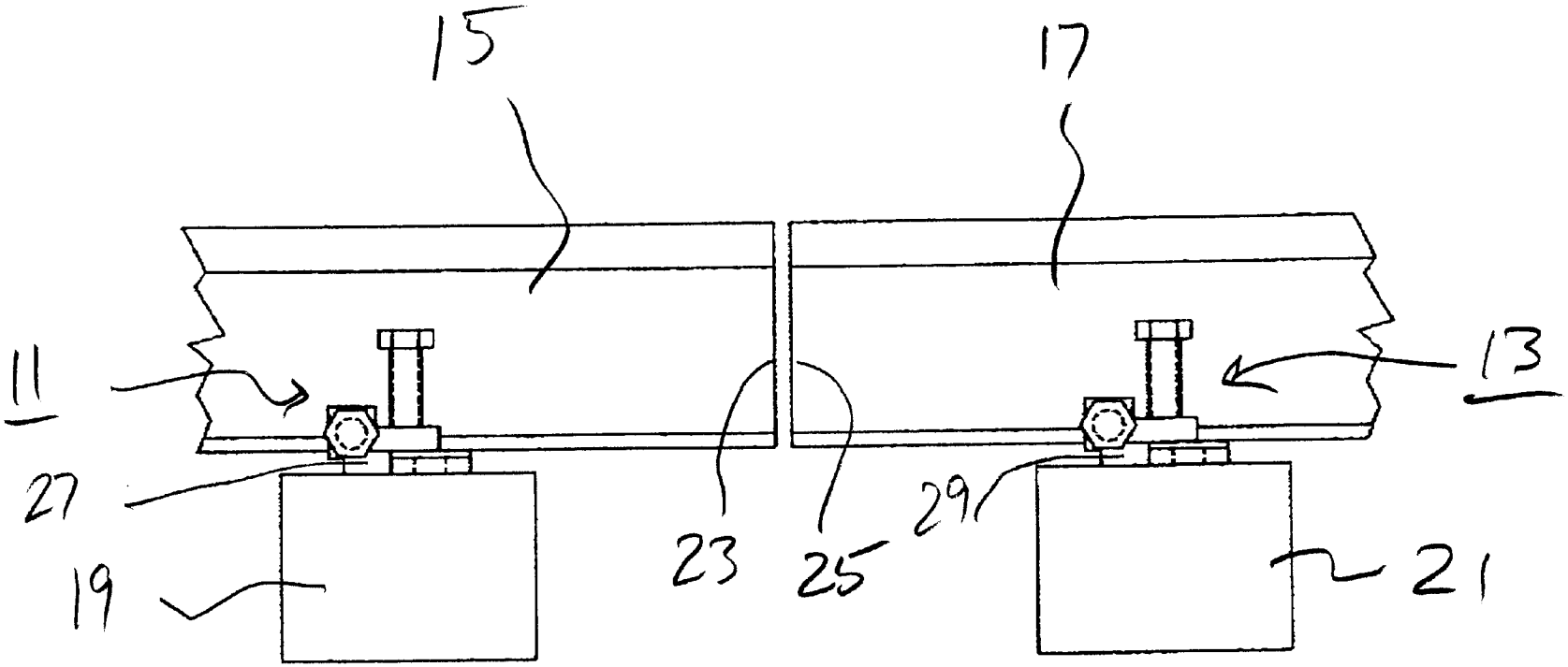
FIG. 2 is a side view of rail alignment tools 11, 13 of FIG. 1.

FIG. 2 is a side view of rail alignment tool 11 and rail alignment tool 13 of the present invention. As is shown, plates 27, 29 are located between wooden ties 19, 21 and rails 15, 17.

Figure 3:
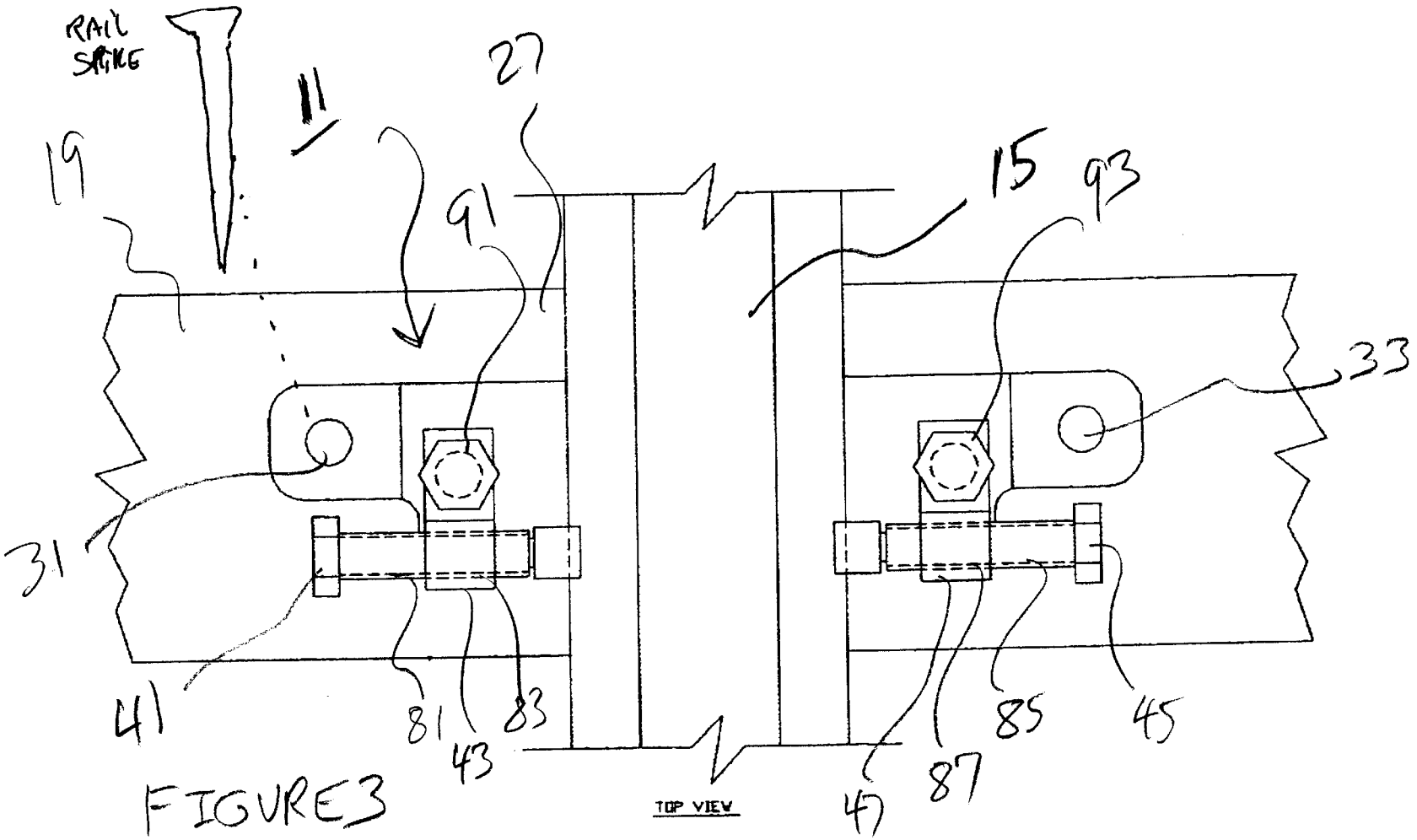
FIG. 3 is a top detailed view of rail alignment tool 11 of FIG. 1.

FIG. 3 is a detailed view of rail alignment tool 11 of FIG. 1. As is shown schematically bolt 41 includes exterior threads 81 and block 43 includes interior threads 81. Rotation of bolt 41 in one direction advances bolt 41 inward toward rail 15, while rotation of bolt 41 in the opposite direction moves bolt 41 outward relative to rail 15. Block 41 is secured by bolt 91 to plate 27. Likewise, bolt 45 includes external threads 85, while block 47 includes internal threads 87. Rotation of bolt 45 in one direction will advance bolt 45 inward toward rail 15, while rotation of bolt 45 in the opposite direction will move bolt 45 outward from rail 15. Likewise, block 47 is secured to plate 27 by bolt 93.

Figures 4, 5, 6:
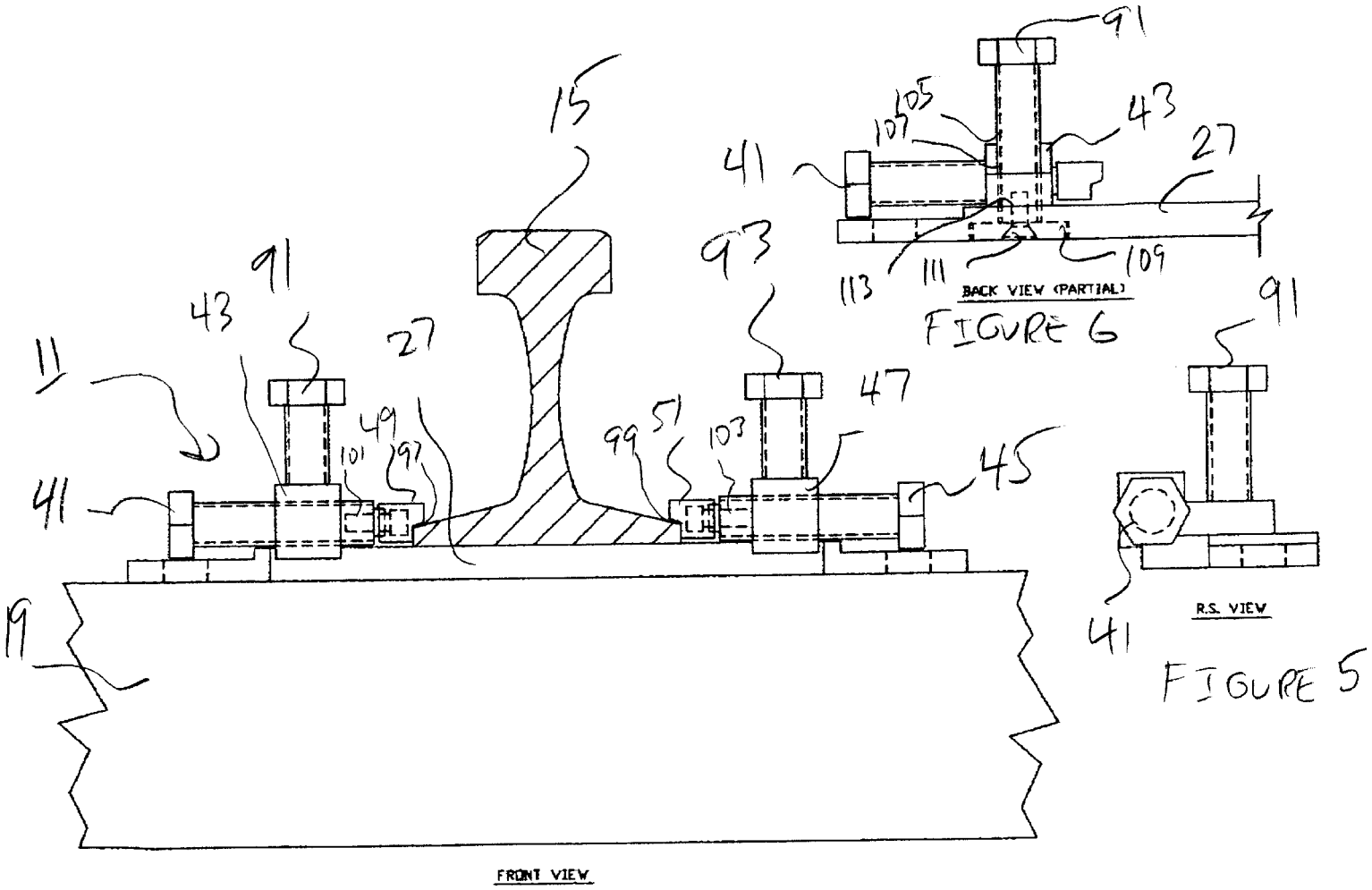
FIG. 4 is a longitudinal section view of rail alignment tool 11 of the view of FIG. 1.
FIGS. 5 and 6 are partial longitudinal section views of rail alignment tool 11 of the view of FIG. 4.
Figure 1:
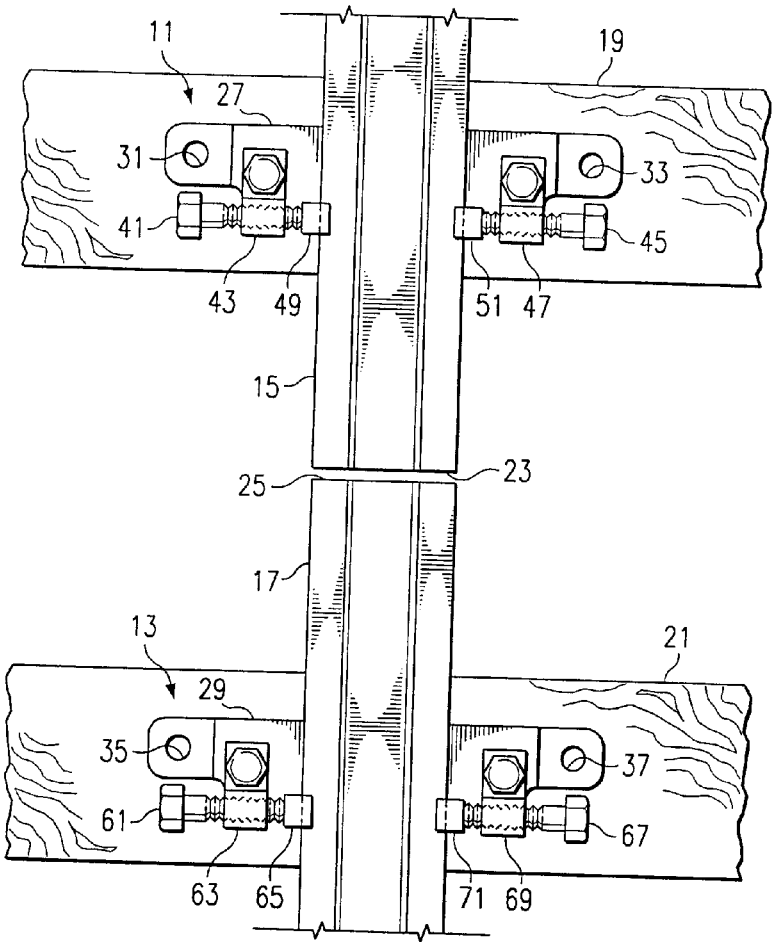
Figure 5:
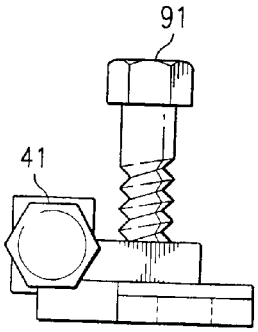
Figure 6:
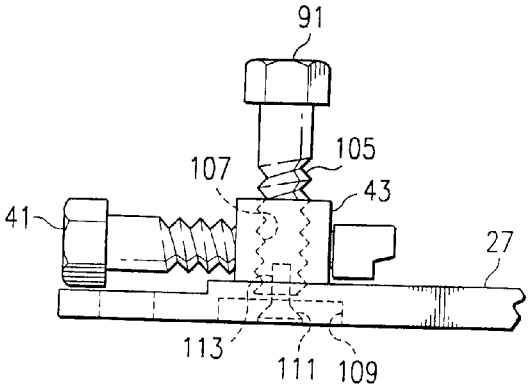
Figure 2:
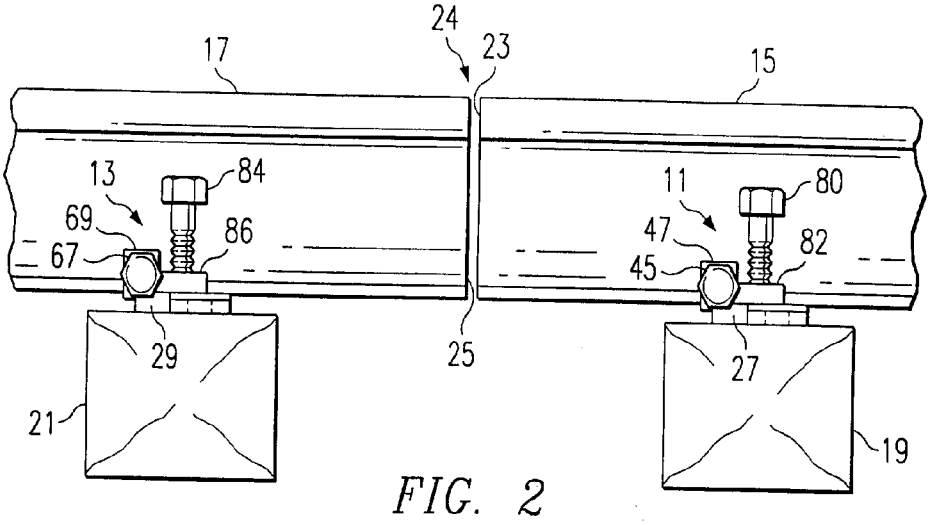
Figure 3:
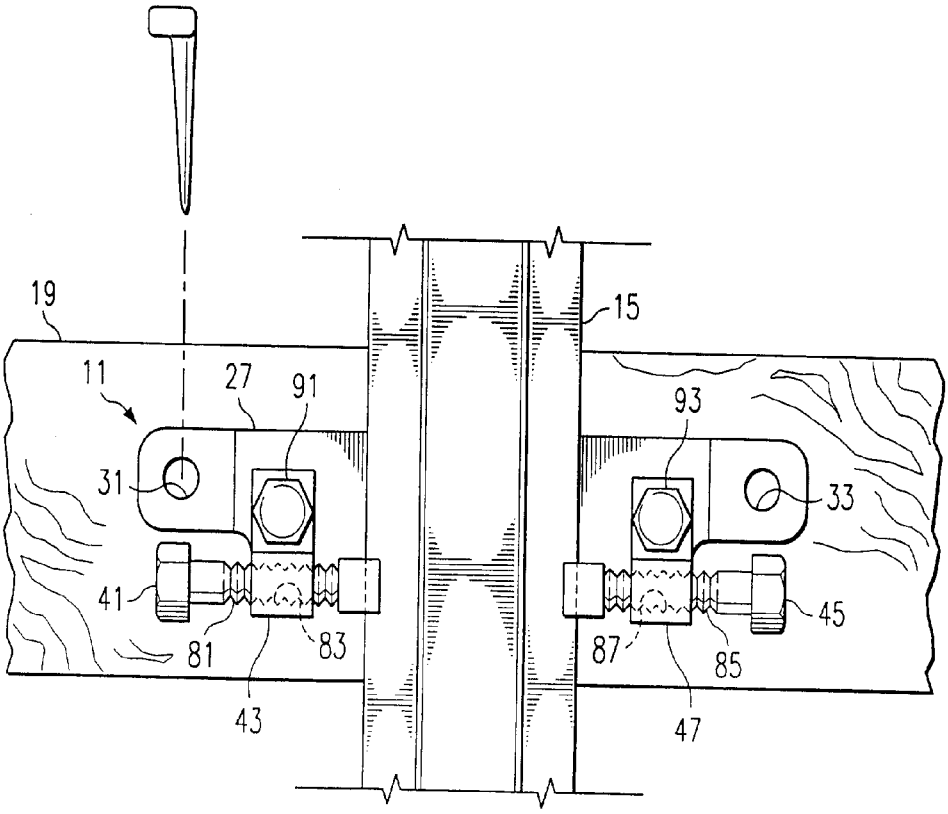
Figure 4:
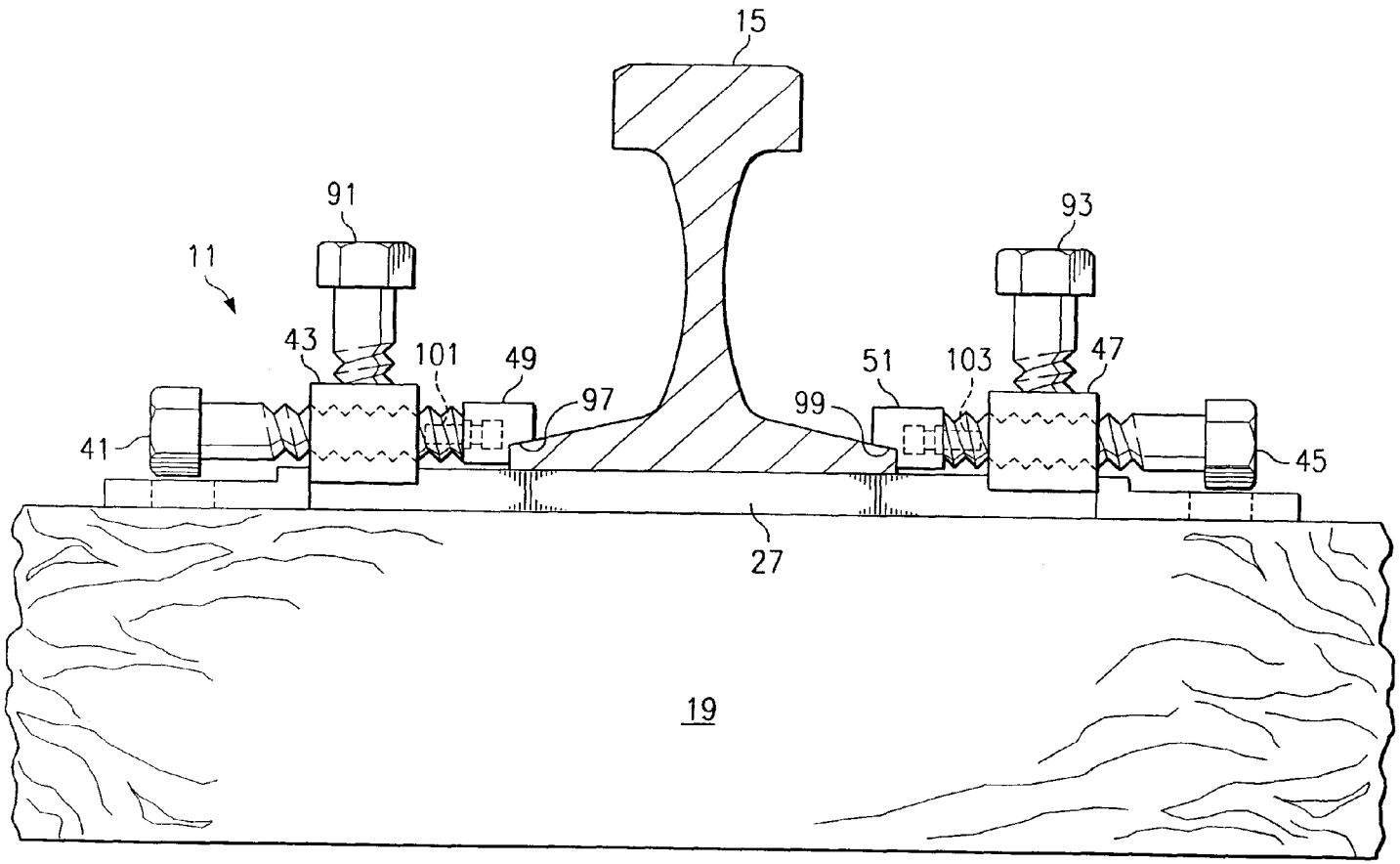

FIG. 4 is a simplified longitudinal section view of rail alignment tool 11 as utilized to engage rail 15. As is shown, plate 27 is positioned between rail 15 and tie 19. Block 43 is secured to plate 27 by bolt 91, while block 47 is secured to plate 27 by bolt 93. Bolts 41, 45 may be torqued relative to blocks 41, 47 in order to put end pieces 49, 51 in force-transference engagement with bottom portion of rail 15. As is shown, end pieces 49, 51 include contoured outer ends 97, 99 which are adapted in shape in order to engage the base portion of rail 15 at the corner or shoulder portion of the base so that force is transferred both in a side-to-side manner and an up-and-down manner. Preferably, end pieces 49, 51 are swivel brackets which have a bit of inherent "adaptability" as they engage rail 15, but which become more rigid as force is applied through the torquing of bolts 41, 45. As is shown, the end pieces are bolted into cavities 101, 103 formed in the ends of bolts 41, 45.

FIG. 5 is a partial longitudinal section view of rail alignment tool 11 of FIG. 4 and it depicts the relative position of bolts 41 and 91, with bolt 41 being utilized to apply load to rail 15, while bolt 91 is utilized to secure block 43 in position relative to plate 27. FIG. 6 is a partial longitudinal section view from a different plane and it depicts the manner in which bolt 91 is secured to plate 27. As is shown, bolt 91 includes external thread 105 which is shown schematically. Likewise, block 43 includes a vertical port which includes external threads 107. A threaded screw port 113 is provided at the outer end of bolt 91 and adapted to receive fastening screw 111 which is located within recess 109 on the bottom surface of plate 27. In this manner, bolt 91 may be raised and lowered relative to block 43 in order to fix the position of block 43, but screw 111 is utilized to prevent the parts from being separated from one another, thus minimizing the chances of bolt 91 of block 43, bolt 41 being separated from plate 27 and misplaced.

What is claimed is:

1. A rail alignment system for locating a first end piece and a second end piece of a first rail section and a second rail section, comprising:

(a) a first rail alignment tool for engaging and applying force to said first rail section, including:
  (1) a planar plate for extending transversely beneath said first rail section;
  (2) a pair of block members, each secured to said planar plate and each defining a threaded cavity which is substantially orthogonal to said first rail section and which are aligned with one another;
  (3) a pair of externally threaded bolts, each adapted for engaging one of said threaded cavities of said pair of block members; and
  (4) a pair of contoured rail engagement end pieces, each secured to an inner terminating portion of said pair of externally threaded bolts for engaging said first rail section;

(b) a second rail alignment tool for engaging and applying force to said second rail section, including:
  (1) a planar plate for extending transversely beneath said second rail section;
  (2) a pair of block members, each secured to said planar plate and each defining a threaded cavity which is substantially orthogonal to said second rail section and which are aligned with one another;
  (3) a pair of externally threaded bolts, each adapted for engaging one of said cavities of said pair of block members; and
  (4) a pair of contoured rail engagement end pieces, each secured to an inner terminating portion of said pair of externally threaded bolts for engaging said second rail section;

(c) wherein said first end piece of said first rail section and said second rail section may be aligned by selectively applying torque to said two pair of externally threaded bolts.

2. A rail alignment system according to claim 1, wherein each of said plates includes means for securing said planar plate in position relative to said first and second rail sections.

3. A rail alignment system according to claim 2, wherein said means for securing said planar plate in position comprises a plurality of rail spike ports.

4. A rail alignment system according to claim 1, wherein each of said pair of block members is releasably fastened to said planar plate.

5. A rail alignment system according to claim 1, wherein each of said contoured rail engagement end pieces comprises a swivel bracket.

6. A rail alignment system according to claim 5, wherein each of said swivel brackets includes a lip portion adapted in shape to engage the shoulder portion of the base of said first and second rail sections.

* * * * *

UNITED STATES PATENT AND TRADEMARK OFFICE

CERTIFICATE OF CORRECTION

PATENT NO. : 6,385,861 B1
DATED : May 14, 2002
INVENTOR(S) : Charles V. Blackwell et al.

It is certified that error appears in the above-identified patent and that said Letters Patent is hereby corrected as shown below:

The title page, showing an illustrative figure, should be deleted and substituted therefor the attached title page.

Delete Drawings Sheets consisting of 1-3, and substitute therefor the Drawings Sheets, consisting of figures 1-6, as shown on the attached pages.

Signed and Sealed this

Thirteenth Day of April, 2004

JON W. DUDAS
*Acting Director of the United States Patent and Trademark Office*

(12) United States Patent
Blackwell et al.

(10) Patent No.: US 6,385,861 B1
(45) Date of Patent: May 14, 2002

(54) RAIL ALIGNMENT TOOL

(75) Inventors: Charles V. Blackwell, Cuba; Terry E. Turner, Rolla; Bobby L. Smith, Cuba, all of MO (US)

(73) Assignee: The Burlington Northern and Santa Fe Railway Company, Fort Worth, TX (US)

( * ) Notice: Subject to any disclaimer, the term of this patent is extended or adjusted under 35 U.S.C. 154(b) by 0 days.

(21) Appl. No.: 09/634,899

(22) Filed: Aug. 9, 2000

Related U.S. Application Data

(60) Provisional application No. 60/147,963, filed on Aug. 9, 1999.

(51) Int. Cl.[7] ..... E01B 29/04; E01B 33/00; B25B 27/14; B25B 1/20

(52) U.S. Cl. ..... 33/651.1; 269/43; 104/7.2; 104/2; 29/271

(58) Field of Search ..... 33/613, 645, 521, 33/523, 523.1, 651.1, 651, 1 Q, 287, 338, 533; 269/43; 29/271, 272; 228/49.3, 49.4; 104/2, 7.2

(56) References Cited

U.S. PATENT DOCUMENTS

| | | | | | |
|---|---|---|---|---|---|
| 700,994 | A | | 5/1902 | Torre et al. | 219/53 |
| 3,711,920 | A | * | 1/1973 | Simmons, Jr. | 269/43 |
| 3,888,477 | A | * | 6/1975 | Tate | 269/43 |
| 4,195,828 | A | * | 4/1980 | Peterson | 269/43 |
| 4,270,036 | A | | 5/1981 | Zollinger | 219/53 |
| 4,320,708 | A | | 3/1982 | Bommart | 104/112 |
| 4,413,415 | A | * | 11/1983 | Stovall | 269/43 |
| 4,641,818 | A | | 2/1987 | Bommart | 269/43 |
| 4,674,730 | A | | 6/1987 | Roberts | 269/43 |
| 4,750,662 | A | * | 6/1988 | Kagimoto | 269/83 |
| 4,800,817 | A | | 1/1989 | Carstensen et al. | 104/2 |
| 4,960,137 | A | * | 10/1990 | Pott et al. | 269/43 |
| 5,094,004 | A | * | 3/1992 | Wooten | 33/338 |
| 5,297,482 | A | * | 3/1994 | Cleveland | 104/7.2 |
| 5,575,416 | A | | 11/1996 | Oellerer et al. | 228/49.1 |
| 6,220,169 | B1 | * | 4/2001 | Rosenquist et al. | 104/2 |

FOREIGN PATENT DOCUMENTS

| | | | | |
|---|---|---|---|---|
| DE | 32-09-984 A1 | * | 10/1981 | 269/43 |

* cited by examiner

*Primary Examiner*—Randy W. Gibson
(74) *Attorney, Agent, or Firm*—Melvin A. Hunn; James E. Walton; Hill & Hunn, LLP

(57) ABSTRACT

A rail alignment system for locating a first end piece and a second end piece of a first rail section and a second rail section. The rail alignment system comprises (a) a first rail alignment tool for engaging and applying force to said first rail section; and (b) a second rail alignment tool for engaging and applying force to said second rail section. The first rail alignment tool includes: (1) a planar plate for extending transversely beneath said first rail section; (2) a pair of block members, each secured to said planar plate and each defining a threaded cavity which is substantially orthogonal to said first rail section and which are aligned with one another; (3) a pair of externally threaded bolts, each adapted for engaging one of said threaded cavities of said pair of block members; and (4) a pair of contoured rail engagement end pieces, each secured to an inner terminating portion of said pair of externally threaded bolts for engaging said first rail section. The second rail alignment tool includes: (1) a planar plate for extending transversely beneath said second rail section; (2) a pair of block members, each secured to said planar plate and each defining a threaded cavity which is substantially orthogonal to said second rail section and which are aligned with one another; (3) a pair of externally threaded bolts, each adapted for engaging one of said cavities of said pair of block members; and (4) a pair of contoured rail engagement end pieces, each secured to an inner terminating portion of said pair of externally threaded bolts for engaging said second rail section. Said first end piece of said first rail section and said second rail section may be aligned by selectively applying torque to said two pair of externally threaded bolts.

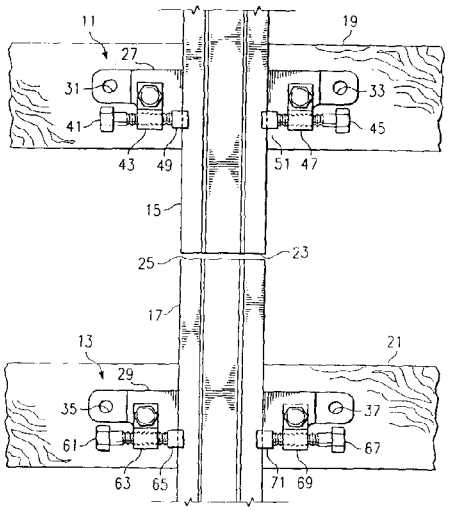

6 Claims, 4 Drawing Sheets